United States Patent [19]

McAnulty et al.

[11] 4,038,504

[45] July 26, 1977

[54] ROTARY, PRINTED CIRCUIT WAFER SWITCH AND METHOD FOR ADJUSTING

[75] Inventors: James C. McAnulty, Dunedin; Edwin B. McCarthy, Clearwater, both of Fla.

[73] Assignee: A.C. Nielsen Company, Northbrook, Ill.

[21] Appl. No.: 633,503

[22] Filed: Nov. 19, 1975

[51] Int. Cl.[2] ..... H01H 9/00; H01H 19/58

[52] U.S. Cl. ..... 200/11 DA; 200/11 G; 200/257; 200/292; 200/293; 200/295

[58] Field of Search ..... 200/11 R, 11 DA, 11 G, 200/11 J, 11 K, 275, 283, 292, 293–296, 257

[56] References Cited

U.S. PATENT DOCUMENTS

| | | | |
|---|---|---|---|
| 2,847,523 | 8/1958 | Van Amelsfort | 200/292 X |
| 3,098,130 | 7/1963 | Clavel | 200/11 K |
| 3,200,208 | 8/1965 | Mastney | 200/11 G X |
| 3,394,236 | 7/1968 | Grundig et al. | 200/11 J |
| 3,440,640 | 4/1969 | Droniou et al. | 200/11 DA |
| 3,518,389 | 6/1970 | Doering, Jr. et al. | 200/11 DA |
| 3,594,527 | 7/1971 | Brant et al. | 200/293 X |
| 3,621,162 | 11/1971 | Wall | 200/11 DA X |
| 3,924,185 | 12/1975 | Schwartz | 200/11 G X |

*Primary Examiner*—James R. Scott

[57] ABSTRACT

A wafer switch includes a printed circuit board having etched thereon a common ring and a desired number of contacts having parallel sides at an angle to a radius of the common ring, and includes a rotor. The rotor has mounted on one side a blade that bridges between a contact and the common ring accomplishing a switching function. The switch further includes a spacer ring and a wave washer that establish a bearing distance between the rotor and the printed circuit board. Finally, the improved wafer switch includes a snap-in bushing intended to pass through an aperture in the board and an aperture in the rotor. The aperture in the rotor is smaller in diameter than the bushing so that the bushing is frictionally mounted within the aperture.

16 Claims, 8 Drawing Figures

Fig. 5
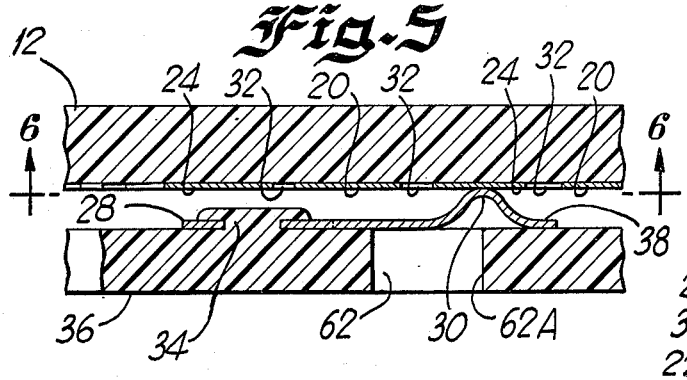
Fig. 6
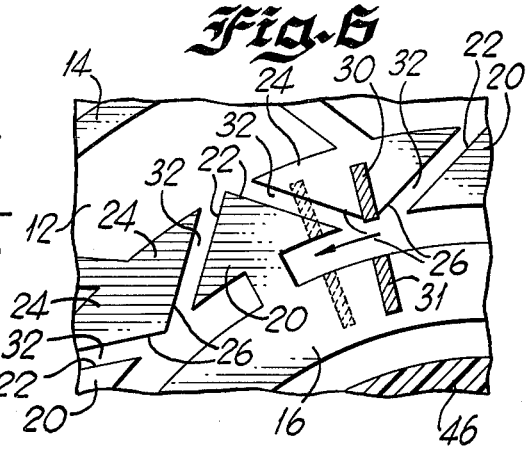
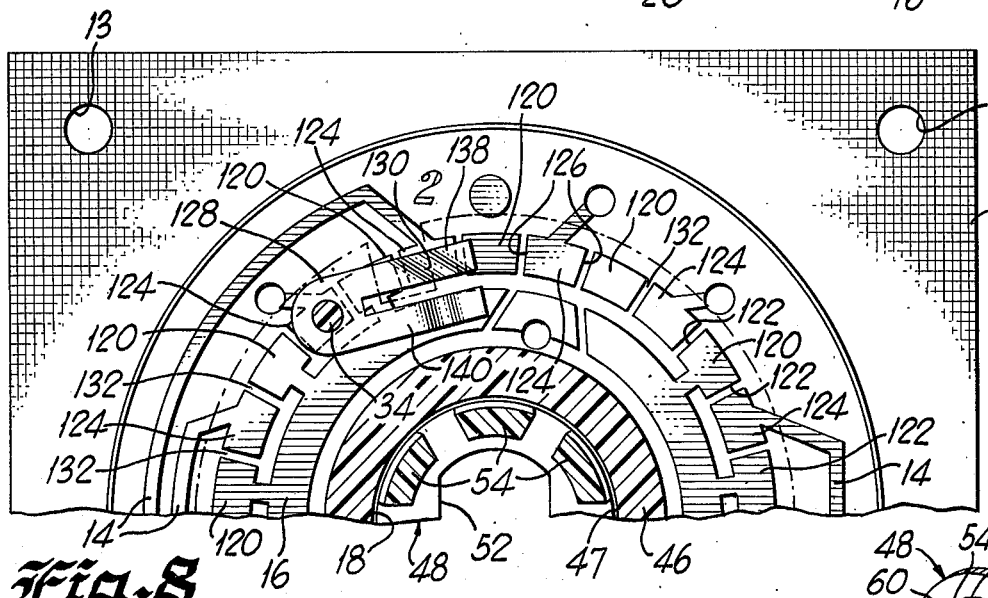
Fig. 8
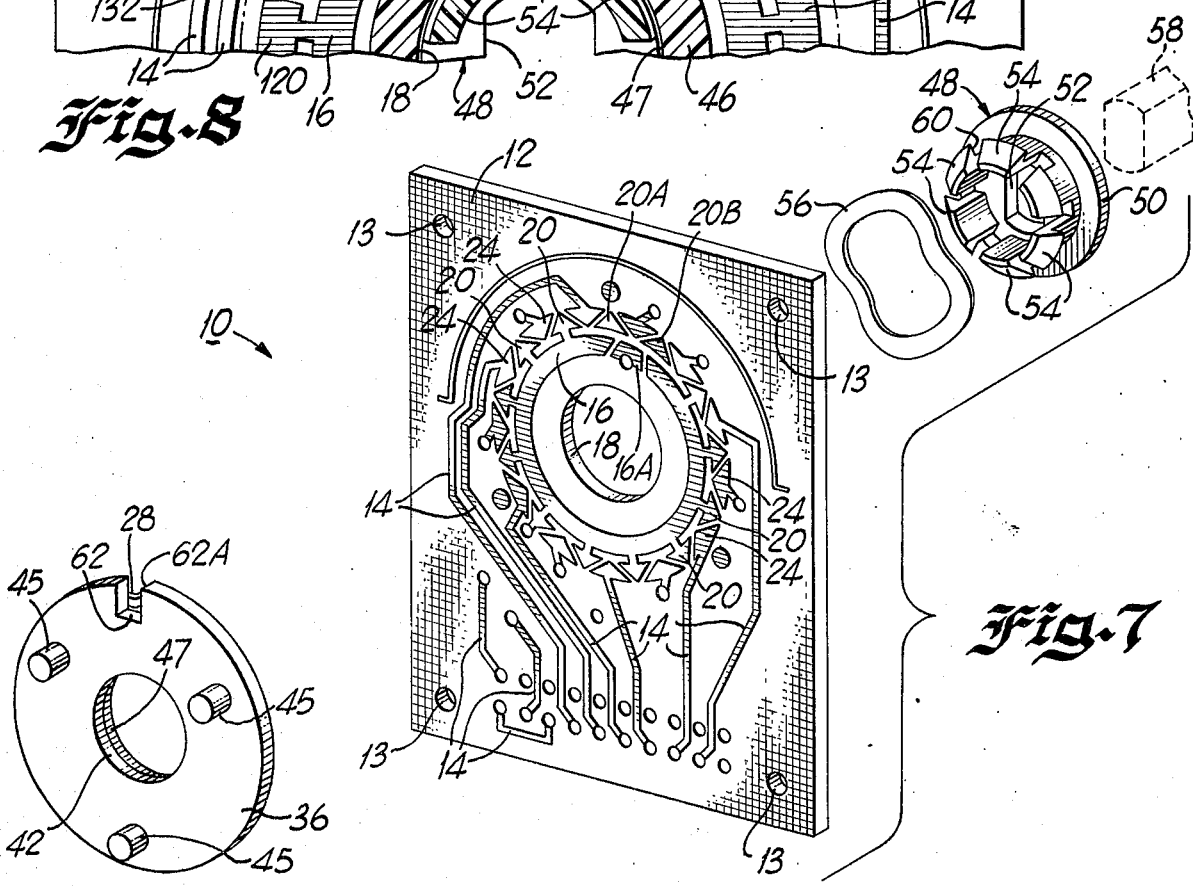
Fig. 7

ROTARY, PRINTED CIRCUIT WAFER SWITCH AND METHOD FOR ADJUSTING

BACKGROUND OF THE INVENTION

A. Field of the Invention

The device of the present invention relates to a new and improved wafer switch that may be adjusted independent of a printed circuit board included in the switch and of the position of an operating shaft, and to a new and improved method for continuous adjustment of a multiple position wafer switch relative to a printed circuit board and operating shaft.

B. Description of the Prior Art

In switching arrangements wherein a multiple position wafer switch is employed, preliminary adjustment of the switch blade prior to installation is difficult; particularly in close quarters such as a tuner of a television.

Typically, in a television tuner, the wafer switch includes a printed circuit board such that its switch or wiper blade abuts one or more contacts etched upon the board. In addition, the wafer switch is connected or secured to the shaft of the television tuner knob and must rotate with the tuner knob so the wiper blade will abut the appropriate contact. A digital output instrument is electrically connected to the circuit board and records the position of the blade and thus the channel to which the tuner is turned.

In this environment, the wafer switch may not be preadjusted relative to the tuner knob and requires adjustment after installation on the tuner shaft.

Another problem with the typical prior art wafer switch is that during rotation of the wiper blade drops between contacts onto the insulating circuit board whereupon the abrasive action of the board on the wiper produces excessive wear. The wiper material may also smear across the board surface into the gap between contacts thereby shorting adjacent contacts and resulting in switch failure.

A further problem with prior art wafer switches is their inability of have continuous adjustment as opposed to incremental ratchet type adjustment in positioning the wiper blades on the appropriate contact. This results in significant problems in small enclosures where adjustment is difficult.

SUMMARY OF THE INVENTION

An object of the present invention is to provide a new and improved device that is small in configuration and may serve a switching function for handling low voltage and current.

Another object of the present invention is to provide a new and improved wafer switch that is capable of continuous adjustment independent of an actuating shaft and, upon adjustment to the desired position, may be secured so as to move with the shaft.

In addition, a further object of the present invention is to provide a new and improved method for continuously adjusting a wafer switch.

Moreover, an object of the present invention is to provide a new and improved wafer switch including a printed circuit board wherein the board includes contacts of a configuration that, in conjunction with the wiper blade of the switch, results in a break-before-make switch wherein the wiper blades do not contact the printed circuit board between adjacent contacts.

Additionally, a further object of the present invention is to provide a method of automatically indicating the position of the tuner knob on a television.

Briefly, the present invention is directed to a new and improved wafer switch that, in a specific embodiment, may be used with a television tuner to record the position of the tuner knob. The wafer switch includes an apertured, printed circuit board upon which are etched wires; a segmented, common ring; and a position ring segmented into a predetermined number of contacts. The position ring contacts include sides that are at an angle to the radius of the common ring.

The wafer switch also includes an apertured, circular rotor that supports a wiper blade mounted on one side thereof. The rotor has one or more knobs fabricated therein that may be gripped to rotate the rotor.

In addition, there is included a plastic spacer ring that may be integrally fabricated on the rotor or may be a separate piece. The ring serves to establish a bearing distance between the rotor and the board so that the wiper blade bears against the contacts with the proper pressure at all times. The contact abutting portion of the wiper blade lies along a radius of the common ring such that tipping or rocking of the wiper blade onto the circuit board between contacts is prevented.

The wafer switch also includes a pronged, segmented, snap-in bushing having a flat, apertured, circular body with extending prongs. The aperture in the circuit board is larger in diameter and the aperture in the rotor is smaller in diameter than the unstressed bushing prongs. Accordingly, upon the bushing prongs being pressed into the apertures of the circuit board and rotor, the spring or prong arms give in toward the center to permit assembly and partially recover outward upon assembly. The prongs upon recovery hold the wave washer, circuit board and rotor together without the use of conventional fasteners. Moreover, the oversized diameter of the hole in the circuit board permits the bushing to turn freely relative to the circuit board.

The undersized diameter of the rotor apparatus maintains a controlled amount of cantilever bend in the prongs thus producing a force between the prongs and the inner peripheral tapered surface of the rotor aperture. This force produces a predetermined amount of frictional resistance to turning or torsion between the rotor and bushing.

The dimensions of the rotor aperture and the unstressed bushing prongs are chosen so that the frictional torsion grip is greater than the drag moment of the wiper and rotor on the circuit board but less than the resisting moment of the shaft on television tuners or similar devices that are inserted in the aperture of the bushing.

Finally, the wafer switch includes a wave washer positioned about the prongs of the bushing and between the circuit board and the body of the bushing.

Upon assembly, the rotor knobs and thus the wiper blade may be gripped by hand or with a thin spanner wrench and rotated independent of the board, bushing and tuner shaft. In this manner, the wiper blade may be positioned on a preselected contact. After such positioning, the rotor is secured to the bushing prongs by the aforementioned frictional grip, welding, heat staking, or bonding, and thereafter the rotor and blade move with the bushing and shaft.

BRIEF DESCRIPTION OF THE DRAWINGS

The above and other objects and advantages and novel features of the present invention will become apparent from the followng detailed description of a preferred embodiment of the invention illustrated in the accompanying drawings, wherein:

FIG. 5 is an enlarged view of the device of the present invention taken along line 5—5 of FIG. 4;

FIG. 6 is an enlarged view of the device of the present invention taken along line 6—6 of FIG. 5;

FIG. 7 is an exploded view of the device of the present invention; and

FIG. 8 is a fragmentary view of an alternative embodiment of the present invention.

DESCRIPTION OF THE PREFERRED EMBODIMENT

Figure 1:
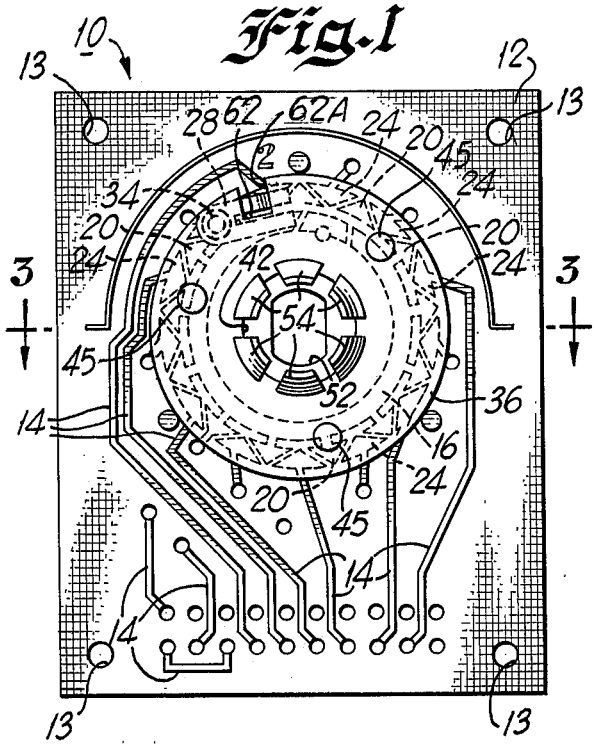
FIG. 1 is an enlarged, plan view of a preferred embodiment of a wafer switch and constructed in accordance with the principles of the present invention.
Figure 2:
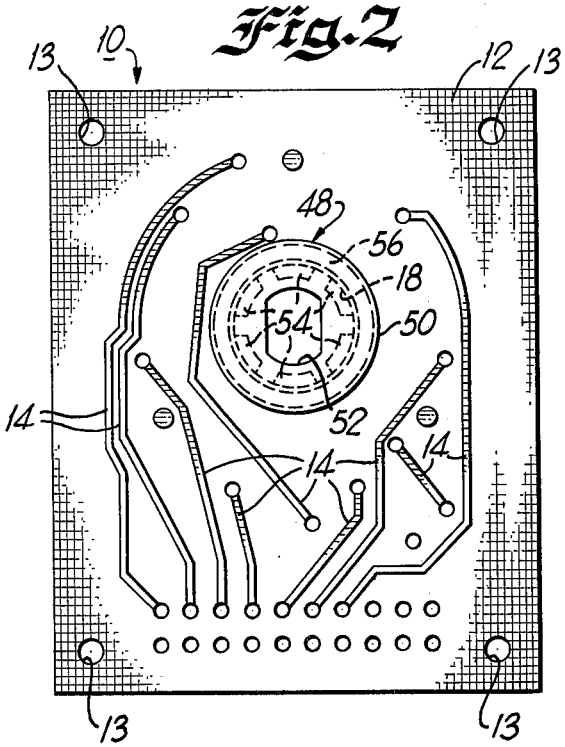
FIG. 2 is a view of the opposite side of the device illustrated in FIG. 1.
Figure 3:
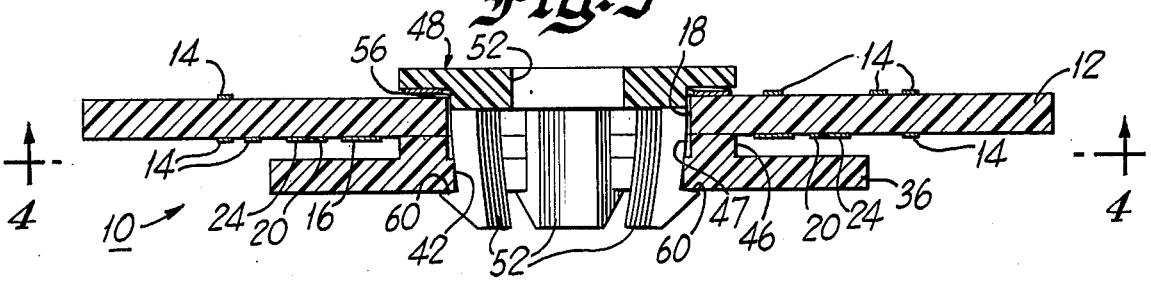
FIG. 3 is a cross-sectional view of the device of the present invention taken along line 3—3 of FIG. 1.

With reference to FIGS. 1-7 of the drawings, there is illustrated a new and improved wafer switch 10 that includes a printed circuit board 12. The board 12 may be fabricated from laminated, fiber glass epoxy and has mounting holes 13 allowing the board 12 to be attached to a television tuner or the like. The circuit board 12 has etched thereon a plurality of wires 14 in a manner and configuration well known in the art.

In addition, the printed circuit board 12 has etched thereon a segmented common ring 16 concentric with an aperture 18 extending through the board 12. The common ring 16 includes extending fingers 20 that, in accordance with an important feature of the present invention, are fabricated in a configuration with sides 22 that are at an angle to a radius of the aperture 18. Two of the fingers 20A and 20B are islands that prevent shoring of the common ring segment 16A. Common segment 16A and contact 24A when bridged by the wiper blade transfers the detection of television channels from the VHF tuner to the UHF tuner; specifically, it enables another switch 10 to be fastened to the UHF tuner.

Also, in accordance with an important feature of the present invention, the wires 14 terminate in contacts 24 that include sides 26 that are parallel to sides 22 and are at an angle to the radius of the aperture 18.

The configuration of the fingers 20 and contacts 24 (FIG. 6) are such that a wiper blade 28, having bent portion 30 abutting the fingers 20 and contacts 24, touches the contact, as it passes from one finger, for example 20, to an adjacent contact, for example 24, while still abutting the first finger 20. This configuration prevents the wiper blade 28 and, in particular, the abutting portion 30 from wiping or dipping onto the printed circuit board 12 in the space 32 between adjacent fingers 20 and contacts 24 (FIG. 6). This reduces abrasive action on the abutting portion 30 of the blade 28. This also prevents material from the blade 28 from smearing into the space 32 between adjacent fingers 20 and contacts 24 thereby shorting between the fingers 20 and contacts 24.

In the preferred embodiment, the wiper blade 28 is positioned on peg 34, aligned in slot 67 and secured by heat staking the peg 34 to a rotor 36 that may be fabricated from plastic or similar material. As is well known in the art, the wiper may be attached to the rotor by several different methods such as heat staking, ultrasonic staking, gluing, bonding, eyeletting, riveting or molding in place.

Figure 4:
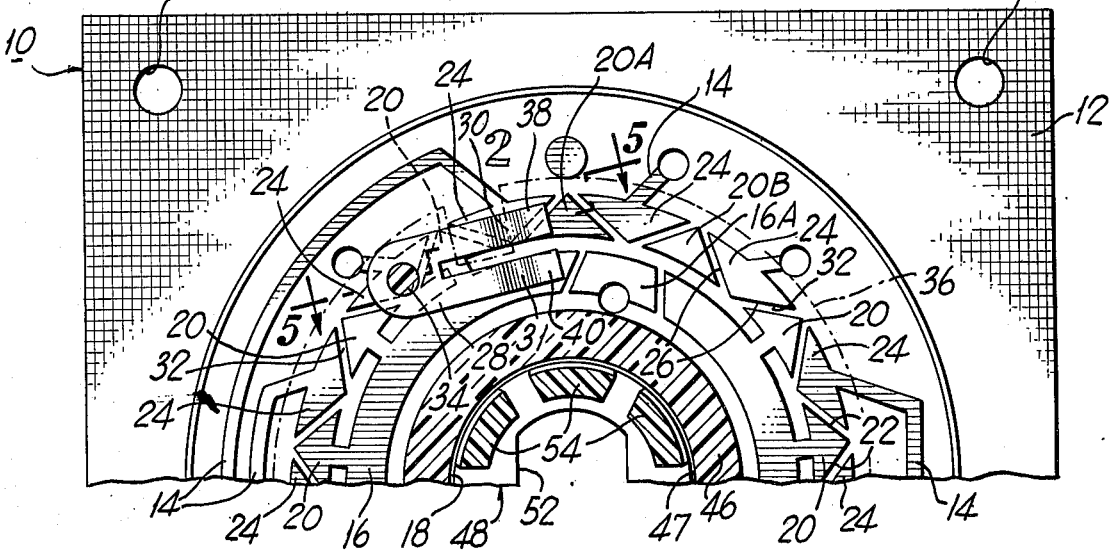
FIG. 4 is a cross-sectional view of the device of the present invention taken along line 4—4 of FIG. 3.

To allow the wiper blade 28 to contact both the common ring 16 and the contacts 24, the blade 28 is bifurcated into portions 38 and 40. Each portion 38 and 40 is also bifurcated into two redundant portions and is bent in a configuration resulting in a loop or abutting portions 30 and 31 that abut and slide across contacts 24 and the common ring, respectively (FIG. 4). The rotor 36 also includes a central aperture 42 and, in a preferred embodiment, a plurality of knobs 45 fabricated at preselected positions on the surface of the rotor 36. These knobs 45 may be gripped by the hand of the installer or engaged by a thin spanner wrench to overcome the friction grip and turn the rotor around the fixed bushing and board for alignment of the wiper to a specific contact.

In assembly of the wafer switch 10, the rotor 36 is mounted with the attached wiper blade 28 adjacent to the circuit board 12 in a manner such that the abutting portions 30 and 31 of the bifurcations 38 an 40 touch the printed circuit board 12 on the common ring 16 and the contacts 24. The diameter of the rotor 36 is such that the outer periphery of the rotor 36 overlies and covers the common ring 16 and the series of contacts 24 thus affording protection against damage.

Furthermore, an integral spacer ring 46 that may be fabricated from plastic or the like is integral with the rotor 36 such that aperture 47 of ring 46 is concentric with the aperture 42 of rotor 36 and lies between the rotor 36 and the printed circuit board 12. In this manner, the plastic spacer ring 46 establishes a bearing distance between the rotor 36 and the circuit board 12 such that the wiper blade 28 is positioned to allow the abutting portions 30 and 31 to bear against the contacts 24 and the common ring 16 with the proper pressure at all times.

In accordance with further important features of the present invention, the wafer switch 10 includes a bushing 48. The bushing 48 comprises a circular body portion 50 having a central aperture 52 therethrough. Aperture 52 has a configuration, such as D-shape, that is complementary to a shaft 58, for example a tuner shaft, wherein the shaft 58 is inserted into aperture 52 and rotation of the shaft 58 imparts rotation to the bushing 48. Integral with and extending in a circular configuration from the body portion 50 are a series of resilient prongs 54 including on the end of each an integral flange 60 (FIG. 7).

During assembly of the wafer switch 10, a wave washer 56 is positioned between the bushing 48 and the circuit board 12 thus providing sufficient force to maintain the rotor 36 firmly on the board 12 so that the wiper 28 and the portions 30 and 31 do not lose touch with the contacts 24 or the common ring 16.

The wave washer 56 is mounted around the resilient prongs 54 of the bushing 48 and the prongs 54 are passed through aperture 18 from the side of the board 12 opposite the contacts 24. The aperture 18 is of approximately the same diameter as the unstressed prongs 54.

Finally, the rotor 36 is pressed onto the resilient prongs 54 by inserting the prongs 54 through the central aperture 42 of the rotor 36. The diameter of the unstressed resilient prongs 54 is slightly larger than the diameter of the rotor 42. Accordingly, upon the prongs 54 being pressed into the aperture 42, the resilient prongs 54 give in toward the center to permit assembly and then recover outwardly. However, due to the smaller diameter of the aperture 42, full recovery to the normal position of the resilient prongs 54 is not possible.

The undersized inner diameter of the aperture 42 maintains a controlled amount of cantilever bend in the resilient prongs 54. This produces a force between the prongs 54 and the inner peripheral surface of the rotor aperture 42. This force results in a fixed amount of frictional resistance to turning of the rotor 36 relative to the bushing 48. The dimensions of the aperture 42 and the peripheral diameter formed by the resilient prongs 54 are preselected such that the frictional resistance between the peripheral surface of the aperture 42 and the outer surface of the resilient prongs 54 is greater than the drag moment developed by the movement of the rotor shoulder or spacer on the circuit board and the abutting portions 30 and 31 of wiper blade 28 over the fingers 20 an contacts 24 and the common ring 16. However, the frictional resistance is less than the resulting moment created by fingers or the spanner wrench applied to knobs 45 to move rotor 36 from one frictional set position on bushing 48 to another frictional set position on bushing 48.

Accordingly, upon complete assembly of the wafer switch 10, the shaft 58 or similar mechanism may be inserted into the aperture 52 of the bushing 48. The aperture 52 of the bushing 48 will be of a configuration complimentary to the shaft 58 whereas the configuration of the aperture 18 in the circuit board 12 and apertures 47 and 42 in the spacer ring 46 and rotor 36, respectively, are larger and different than the aperture 52. Moreover, the circuit board 12 is secured to the tuner and cannot rotate. In this manner, rotational movement of the shaft 58 imparts rotation to the integral unit comprising the bushing 48, the rotor 36 and the wiper 28.

After assembly of the wafer switch 10, and after mounting the circuit board 12 in a television tuner (not shown) or the like, the rotor 36 may be gripped by the knobs 45 and rotated independently of the board 12 and the bushing 48. The rotor 36 includes a slot 62 having an edge 62A. By aligning the edge 62A with wire 14 having the indicia 2 (FIG. 4), the portion 30 is circumferentially centered on contact 24 of this wire 14. In this manner, the rotor 36 may be rotated independently of the remaining portions of the wafer switch 10 to center the abutting portion 30 on a preselected contact 24.

In a typical situation, the tuner knob (not shown) and, consequently shaft 58, would be rotated to a selected receiving station number. Thereafter, the rotor 36 would be rotated such that the abutting portion 30 or bifurcation 38 would abut the appropriate contact 24. For example, the tuner knob may be turned to channel 2 and the rotor 36 rotated until portion 30 abuts the contact 24 corresponding to channel 2 (FIG. 1).

Once the rotor 36 had been positioned in this manner, the rotor 36 is secured to the bushing 48 by friction such that rotation of the bushing 48 imparts similar rotation to the rotor 36.

In this manner, subsequent rotation of the television tuner dial (not shown) imparts motion to the shaft 58 and similar motion to the bushing 48 with corresponding movement of the rotor 36 and blade 28. The abutting portion 30 of bifurcation 38 is of a width such that it bridges adjacent contacts 24 and fingers 20 as it moves from one contact to another. The abutting portion 30 never dips into the space 32 between adjacent fingers 20 and contacts 24 and thus never contacts the circuit board 12.

The flanges 60 of prongs 54 on bushing 48 may be welded to rotor 36 using a hot soldering iron or the like that permanently fixes the alignment of such a welded switch. Once welded, it loses its adjustability.

An alternative embodiment of the present invention is illustrated in FIG. 8 wherein similar items are designated by similar reference numerals as those items previously discussed. The circuit board 112 has a plurality of etched wires 14 that include contacts 124 fabricated in a configuration wherein the sides 126 are parallel and lie along a radius of the central aperture 18. Additionally, fingers 120 extend from the common ring 16 and include sides 122 parallel to each other and parallel to the sides 126.

The wiper blade 128 is bifurcated into portions 138 and 140 and portion 138 includes an abutting portion 130 that lies along an angle to the radius of the aperture 18. In this configuration, the wiper blade 128 is rotated and the abutting portion 130 moves from contact to contact, for example, from contact 124 to finger 120. By being at an angle to sides 122 and 126, the abutting portion 130 bridges adjacent fingers 120 and contacts 124, thus never dipping into the spaces 132 between the fingers 120 and contacts 124 and never contacting the circuit board 112.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In combination, a printed circuit board having an aperture and first and second sides, contact array means defined on at least one of said first and second sides, and a switch comprising a substantially planar rotor fabricated of nonconductive material having a central aperture and first and second planar surfaces, at least one switch blade mounted upon said first planar surface, and a bushing fabricated of nonconductive material having resilient spring means of a larger cross-sectional area than the cross-sectional area of said aperture in said rotor, whereby upon insertion of said spring means from said first side through said apertures of said board and said rotor and to said second side of said board, respectively, such that said blade abuts said board on said second side, said spring means is deformed such that the frictional force resulting from said fit in said aperture in said rotor is greater than the drag force resulting from movement of said blade along said second side upon rotation of said bushing so that said bushing and said rotor act in concert as one element and on opposite sides of said board.

2. The combination as set forth in claim 1, said contact array means including a first contact on said second side having a circular configuration concentric with said aperture, and a plurality of second contacts mounted upon said second side of said board and of a configuration wherein the adjacent edges of adjacent contacts are parallel to each other and non-parallel to a radius of said circular contact and to an opposite side of each contact.

3. The combination as set forth in claim 2, said switch blade being bifurcated such that a first bifurcation abuts said first contact and a second bifurcation abuts at least one of said second contacts.

4. The combination as set forth in claim 3, said second bifurcation having a transverse dimension such that said second bifurcation is in continuous abutment with at least one of said second contacts.

5. The combination as set forth in claim 1 further including spacer means between said rotor and said board for maintaining said rotor a predetermined distance from said board, and resilient means for resiliently maintaining said rotor and said switch blades against said contacts.

6. The combination as set forth in claim 1, said bushing including an aperture extending therethrough of a configuration different from that of said aperture in said rotor.

7. A wafer switch comprising a rotor fabricated from nonconductive material having an aperture of a preselected transverse dimension and including at least one resilient switch element, and a bushing having integral spring means, said rotor being adapted to be rotatably mounted on said spring means, said spring means being of a transverse dimension larger than the transverse dimension of said aperture such that upon insertion of said spring means into said aperture the difference in dimensions results in a frictional force resisting movement of said bushing relative to said rotor, said frictional force being greater than a drag force created by said switch element moving over a surface of a member including contact array means for defining a plurality of contacts and mounted on said spring means and between said rotor and said bushing but less than the force by hand or wrench to said rotor thus permitting said rotor to be rotated or adjusted relative to said bushing and said member surface and at the end of said rotation, said bushing and said member again act in concert through the frictional force between them.

8. A wafer switch as set forth in claim 7, said bushing including an aperture extending therethrough of a configuration different from that of said aperture in said rotor.

9. A wafer switch as set forth in claim 7, said member comprising a printed circuit board and said contact array means including a first contact having a circular configuration concentric with an aperture in said board, an a plurality of second contacts mounted upon said board and of a configuration wherein the edges of said contacts are parallel to each other and nonparallel to a radius of said circular contact.

10. A wafer switch as set forth in claim 7, said switch blade being bifurcated such that a first bifurcation abuts said first contact and a second bifurcation abuts at least one of said second contacts.

11. In combination a printed circuit board comprising first and second sides, an aperture and a ring contact concentric with said aperture, and a plurality of contacts on said first side spaced radially from said ring, and alternate contacts being coupled to said ring, each said contact having a configuration wherein the adjacent parallel sides of adjacent contacts lie at a first preselected angle relative to the radius of said ring and a side of each said contact opposite said parallel side lies at a second preselected angle relative to a radius of said ring, a switch comprising a substantially planar rotor having an aperture and first and second sides, at least one switch element mounted on said first side of said rotor perpendicular to a radius of said ring, and a bushing comprising an end portion having first and second sides, integral locking means extending from said first side of said bushing of a larger cross-sectional area than the cross-sectional area of said aperture of said rotor, said rotor being rotatably mounted on said locking means such that said locking means extends through said apertures of said board and said rotor, said rotor being positioned adjacent said contacts and said end portion of said bushing being adjacent said second side of said board, said rotor and said bushing being adapted such that said rotor may be rotated relative to said bushing upon application of a force above a preselected magnitude to said rotor and said rotor and said bushing may be rotated in concert upon application of a rotating force to said bushing, said bushing also including an aperture through said end portion.

12. The combination as set forth in claim 11, said aperture in said bushing being of a different configuration than the configuration of said apertures of said board and rotor.

13. The combination as set forth in claim 11, said switch element being bifurcated such that a first bifurcation abuts said first contact and a second bifurcation abuts at least one of said second contacts.

14. A method of continuous adjustment of a multiple position printed circuit board wafer switch, said switch comprising a bushing having an integral locking member and an aperture extending therethrough, and a rotor having an aperture of a larger cross-sectional area than said bushing aperture and including a switch blade mounted thereon, the cross-sectional area of said locking member being larger than the cross-sectional area of said aperture in said rotor wherein said rotor may be adjusted relative to said bushing and said board independent of the position of a shaft extending through said apertures of said board, bushing and rotor and subsequently set in a desired position whereby said rotor and said bushing are integral, the steps comprising mounting said bushing on a printed board including contact array means for defining at least one contact by passing said locking member through an aperture in said board and through said aperture in said rotor, mounting the assembly of said bushing, board and rotor on a shaft having substantially the same configuration of said aperture in said bushing by extending said shaft through said apertures, securing said board to a support of said shaft, rotating said rotor on said shaft independent of said bushing, board and shaft to a preselected position, and rotating said shaft to rotate said rotor and said bushing as a unit independent of said board.

15. The method set forth in claim 14 further comprising the step of securing said locking member to said rotor in said position such that said shaft, bushing and rotor move together and independently of said board.

16. A method of automatically indicating the station to which a television receiver is tuned comprising the steps of securing to the body of said receiver and fitting to the shaft of a tuner knob a switch including a printed circuit board having an aperture and contact array means for defining at least one contact, a rotor fabricated of nonconductive material having a central aperture, at least one switch blade mounted upon said rotor, and a bushing fabricated of nonconductive material having resilient spring means of a larger cross-sectional area than the cross-sectional area of said aperture in said rotor, whereby upon insertion of said spring means through said apertures of said board and said rotor, respectively, such that said blade abuts said board, said spring means is deformed such that the frictional force resulting from said fit in said aperture in said rotor is greater than the drag force resulting from movement of said blade along the board upon rotation of said bushing, rotating said knob to a desired position, rotating said rotor to the position on said circuit board corresponding to the position of said knob, securing said rotor to said spring means such that rotation of said knob rotates said bushing and rotor, and connecting said circuit board to output means for recording the position of said blade relative to said board.

* * * * *